US005409126A

United States Patent [19]

DeMars

[11] Patent Number: 5,409,126

[45] Date of Patent: Apr. 25, 1995

[54] STORAGE CONTAINER WITH REVERSIBLE LID

[76] Inventor: Robert A. DeMars, 23221 Ladrillo Ave., Woodland Hills, Calif. 91367

[21] Appl. No.: 135,594

[22] Filed: Oct. 13, 1993

[51] Int. Cl.[6] ..... B65D 21/02

[52] U.S. Cl. ..... 220/4.27; 220/23.86; 206/508; 206/501; 206/499

[58] Field of Search ..... 206/508, 501, 499; 220/4.27, 4.26, 23.86

[56] References Cited

U.S. PATENT DOCUMENTS

| | | | |
|---|---|---|---|
| 1,134,427 | 4/1915 | Ullrich . | |
| 3,624,789 | 11/1971 | Peyser | 206/508 |
| 3,749,278 | 7/1973 | von Boch-Galhau | 220/23.83 |
| 4,091,953 | 5/1978 | Daenen | 220/23.86 |
| 4,532,397 | 7/1985 | McClelland | 219/10.55 |
| 4,817,801 | 4/1989 | Schwaikert | 206/508 |
| 4,844,263 | 7/1989 | Hadtke | 206/508 |
| 5,021,351 | 6/1991 | Ervin | 206/508 |
| 5,045,333 | 9/1991 | Petrofsky et al. | 426/394 |

*Primary Examiner*—Joseph Man-Fu Moy
*Attorney, Agent, or Firm*—Jack C. Munro

[57] ABSTRACT

A storage container which includes a base within which is defined a storage compartment. A lid is to be connectable with the base closing the storage compartment to the ambient. The lid is bulbous so that relative to the storage compartment it can be located in a concave position decreasing the size of the storage compartment or a convex position increasing the size of the storage compartment. This reversibility of the lid can be achieved by constructing the lid so as to actually be physically reversible or also by having the lid to be physically deflectable from the convex position to the concave position.

4 Claims, 2 Drawing Sheets

STORAGE CONTAINER WITH REVERSIBLE LID

BACKGROUND OF THE INVENTION

1) Field of the Invention

The field of this invention relates to storage containers and more particularly to a storage container which works in conjunction with a lid so as to vary the size of the storage compartment incorporated within the container.

2) Description of the Prior Art

The present invention will be discussed in terms of a storage container for food with this storage container intended to be utilized within a conventional refrigerator cabinet, drawer or other storing location. However, it is considered to be within the scope of this invention that the storage container can be utilized to store contents other than food.

It is exceedingly common to store food in bowls within refrigerators. This food is then to be consumed at a later time. It has been common practice to utilize a series of different sizes of storage containers with the particular size of storage container being selected to correspond to the amount of food that is to be stored. Therefore, inherently a user must have available several different sizes of storage containers since the quantity of food will generally vary significantly.

In the storing of food, the food will retain its freshness and be more palatable if air is minimized in the storage compartment. In the past, it has been known to construct a food storage container that has a reversible lid. The reversible lid is bulbous and can be adjusted to increase or decrease the size of the storage compartment. When the storage container is utilized to store a contents which are significantly less than the total volume of the storage compartment of the storage container, the lid can be reversed and occupy the upper portion of the storage compartment thereby decreasing the amount of air contained within that storage compartment and hence decreasing the amount of air that comes into contact with the food. However, the prior art storage containers with reversible lids are constructed to be rather complex and of a significant expense to manufacture and thereby to purchase by the consumer.

SUMMARY OF THE INVENTION

A storage container that has an internal storage compartment within a base. The base is to be constructed to be transparent so as to readily allow observation of the contents contained within the storage compartment without removal of the lid. Access into the storage compartment is at a connecting ledge. The ledge is to be connectable with the periphery of a lid. The lid is bulbous assuming a bowl-shaped configuration. In one configuration of this invention the lid is reversible so that in one position the lid enlarges the space within the storage compartment and in another position the lid is locatable within a portion of the storage compartment thereby decreasing the size of that compartment. When the lid is in the position decreasing the size of the storage compartment, it is in alignment with a level indicator formed on the sidewall of the base so that the user will not overfill the contents of the storage compartment when it is intended to use the lid in this position. The lid instead of being physically reversible may be constructed to be reversible by being deflectable.

The primary objective of the present invention is to construct a storage container which is of simple construction and thereby can be manufactured and sold to the ultimate consumer at an inexpensive price.

Another objective of the present invention is to construct a food storage container which can be utilized to store different quantities of food maintaining each quantity of food in the freshest state possible.

Another objective of the present invention is to construct a food storage container which can be readily stacked with other similar food storage containers thereby facilitating storability within storage areas such as a refrigerator.

DETAILED DESCRIPTION OF THE SHOWN EMBODIMENTS

Figure 1:
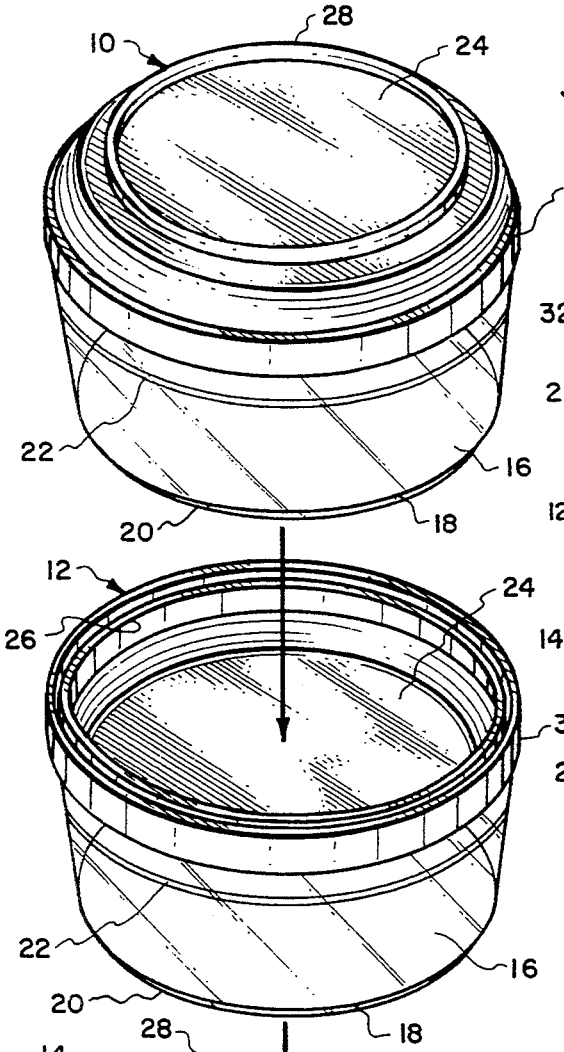
FIG. 1 is an exploded isometric view of three (in number) food storage containers of this invention which utilize a physically reversible lid.
Figure 2:
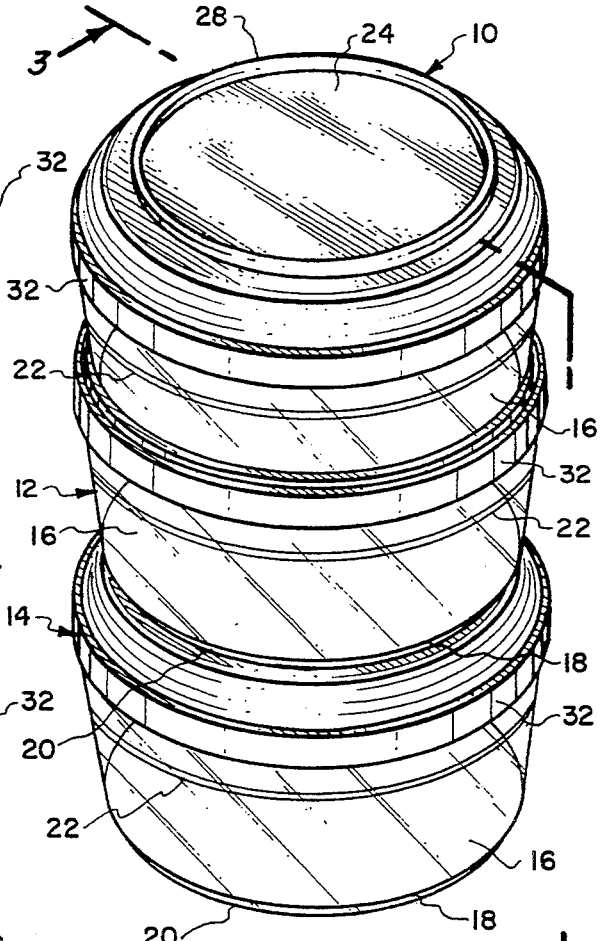
FIG. 2 is a view similar to FIG. 1 but showing the food storage containers located in a stacked relationship with the upper and lower food storage containers of the stack having the lid in a convex position and the center food storage container having the lid in the concave position.
Figure 3:
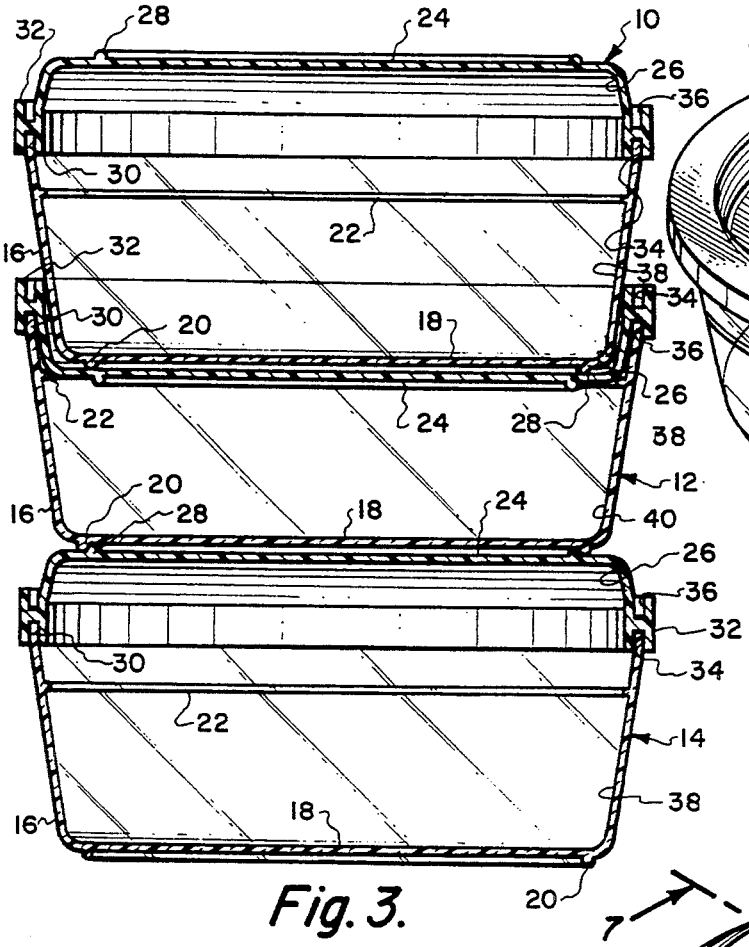
FIG. 3 is a cross-sectional view taken along line 3—3 of FIG. 2.

Referring particularly to the drawings there is shown in FIGS. 1–3 food storage containers 10, 12 and 14. The food storage containers 10, 12 and 14 are all identical with containers 10 and 14 being in a convex position and container 12 being in the concave position. Each of the food storage containers 10, 12 and 14 include a base which has a bottom 18 from which there is integrally connected at the periphery thereof an upstanding sidewall 16. The upstanding sidewall 16 in conjunction with the bottom 18 define a storage compartment with this storage compartment being numbered 38 within storage containers 10 and 14 and numbered 40 for storage container 12. In referring in particular to FIG. 3 it can be seen that the storage compartment 38 is substantially greater in size than the storage compartment 40.

Exteriorly of the bottom 18 there is located an annular ridge 20. This annular ridge 20 facilitates the locating of the base on a supporting structure such as a table or shelf of a refrigerator. Surrounding the access opening into the storage compartment 38 and 40 is a connecting ledge 30. The material of construction for the base will normally be a transparent plastic so the contents that are stored within the storage container can be readily observed without opening the storage container. There is an annular bead 22 formed on the interior wall surface of the sidewall 16. The bead 22 is to function as a level indicator and inform the user to have the contents that are being stored within the base to be below the height of the bead 22 when it is intended that the lid 24 is to be used in a concave position as is shown within storage container 12.

The lid 24 is basically of a bulbous configuration defining an interior chamber 26. The exterior surface of the lid 24 includes an annular bead 28 which is sized to abut against annular bead 20 when two of the food storage containers, such as containers 12 and 14, are located in a stacked position. The interconnection established by beads 20 and 28 will prevent container 12 from sliding off of container 14.

The periphery 24 includes an attaching flange 32. The attaching flange 32 includes an upper annular groove 34 and a lower annular groove 36. The upper annular groove 34 is to connect with the connecting ledge 30 in substantially an airtight manner closing the storage compartment 38 to the ambient. With the upper groove 34 connecting with the ledge 30, the storage container is in the convex position shown by storage containers 10 to 14.

The lid 24 can be disengaged from the base with upper groove 34 being disconnected from the ledge 30. The lid 24 can then be turned over or reversed with the lower groove 36 now connecting with the ledge 30. In this position the bulbous configuration of the lid 24 is located within the upper portion of the storage compartment 40 located in FIGS. 1 and 3 of the drawings. The annular ridge 28 will be positioned in alignment with the level indicating bead 22. It is to be noted that the width of the chamber 26 is greater than the width of the bottom 18 or more specifically the width of the sidewall 16 directly adjacent to bottom 18 so that the storage container 10 can be located in a stacked relationship in conjunction with the storage container 12.

Although the base of the storage container, composed of bottom 18 and sidewall 16, is intended to be constructed to be transparent, the lid 24 may or may not be constructed of a transparent material and in most instances probably will be opaque. Typical material for construction for both the base and lid 24 will be plastic.

Figure 4:
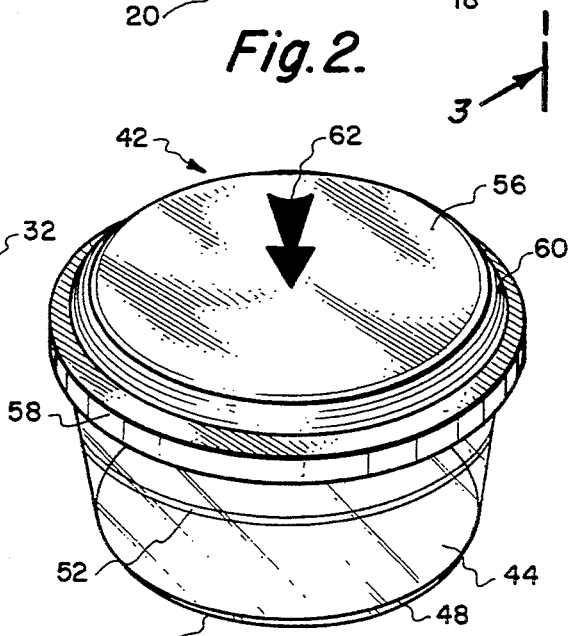
FIG. 4 is an isometric view of a single food storage container which utilizes a deflectable lid with the lid in the convex position.
Figure 5:
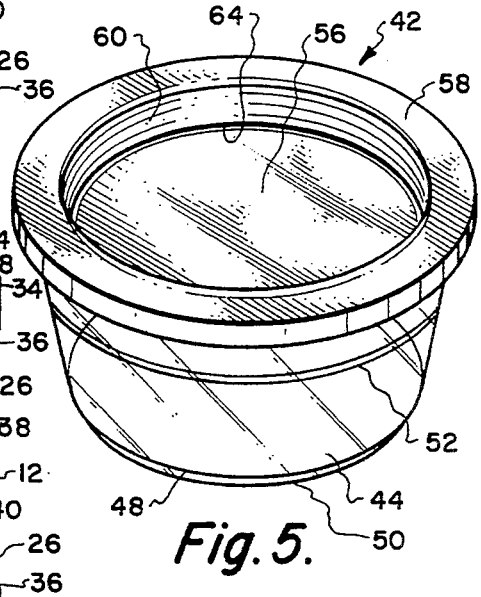
FIG. 5 is an isometric view of the food storage container of FIG. 4 but showing the lid being deflected and in the concave position.
Figure 7:
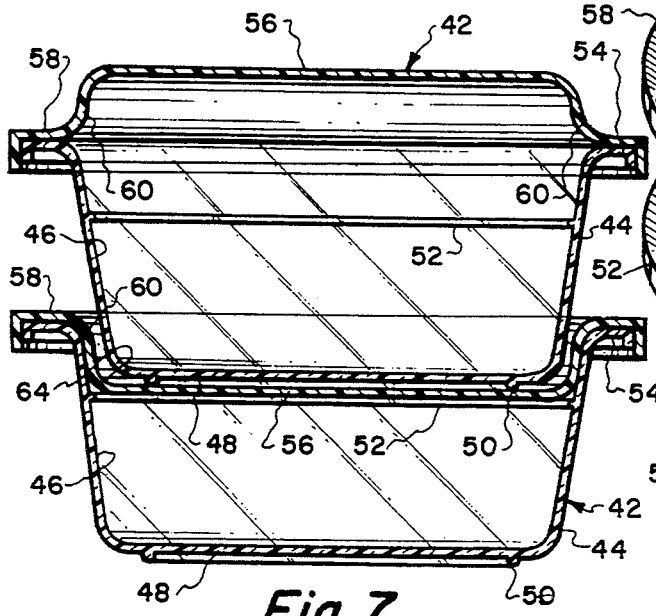
FIG. 7 is a cross-sectional view taken along line 7—7 of FIG. 6.
Figure 6:
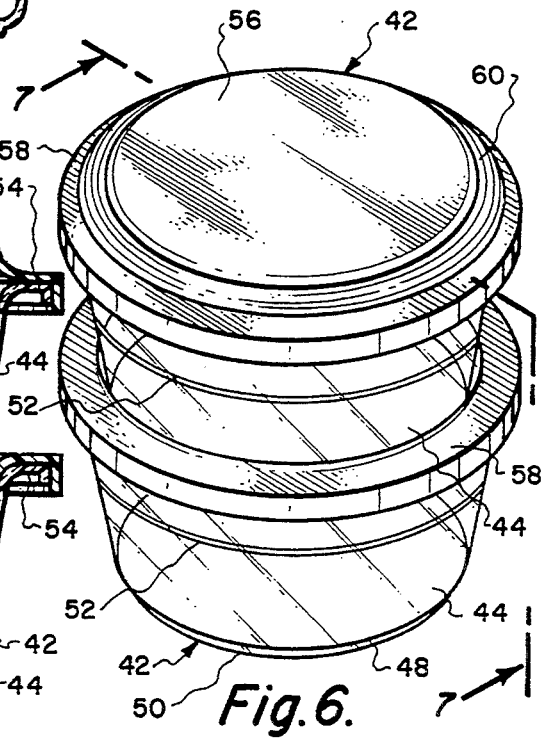
FIG. 6 is an isometric view showing the food storage container of FIG. 4 being stacked onto the food storage container of FIG. 5.

Referring particularly to FIGS. 4 to 7 of the drawings there is shown a food storage container 42. Food storage container 42 includes a base which includes a sidewall 44 which extends at the peripheral edge from a bottom 48. Exteriorly of the bottom 48 is an annular ridge 50 which is similar to ridge 20. Interiorly of the sidewall 44 there is located a storage compartment 46. There is a level indicating bead 52 formed on the interior of the sidewall 44 with this bead 52 being similar and to be utilized in the same manner as bead 22. The periphery of the sidewall 44 is formed into a connecting ledge 54. Engageable with the connecting ledge 54 is an attaching flange 58 of a lid 56. The lid 56 will be constructed of a soft plastic and is to assume a bulbous configuration similar to lid 24. Between the main body of the lid 56 and the attaching flange 58 there is formed an annular pivot joint 60. With the lid 56 in the position as shown in FIG. 4, manual pressure can be applied as indicated by the direction of arrow 62 in FIG. 4 onto the lid 56. When this manual pressure is sufficient, the main body of the lid 56 will deflect pivoting about the pivot joint 60 and with a snapping action will assume the configuration shown in FIG. 5. In the configuration shown in FIG. 5, the bulbous section of the lid 56, instead of being convex as shown in FIG. 4, is now concave as shown in FIG. 5 forming an exterior chamber 64. The bottom 48 of one storage container 42 can be located within the exterior chamber 64 in a stacked relationship as is clearly shown in FIGS. 6 and 7 of the drawings. When the lid 56 is in this convex configuration, the interior surface of the lid is now in alignment with the level indicator 52.

It is to be understood that the lid 56 can have physical pressure applied to it in the direction reverse of arrow 62 when the lid 56 is in the concave position. This will result in the lid 56 being pushed back to the convex position.

What is claimed is:

1. A storage container comprising:

a base, said base having a bottom wall from which extends an enclosing sidewall defining an interior storage compartment, said bottom wall having a predetermined exterior width, said base having an open top providing access into said storage compartment, said sidewall having a connecting ledge at said open top, said base being transparent permitting observing of the contents contained within said storage compartments;

a solid lid having an attaching flange located at the periphery of said lid, said attaching flange to connect with said connecting ledge closing said storage compartment to the ambient, said solid lid having a bulbous portion, said bulbous portion being locatable exteriorly of said storage compartment enlarging the volume of said storage compartment or optionally said bulbous portion being locatable within said storage compartment decreasing the volume of said storage compartment, said bulbous portion having an interior width which is greater than said exterior width of said bottom wall, whereby said bottom wall of one said storage container is locatable against said interior width of said bulbous portion of another said storage container producing a stacked arrangement; and said solid lid being reversible by being physically deflectable from the position exteriorly of said storage compartment to the position located within said storage compartment with said attaching flange remaining connected to said connecting ledge.

2. The storage container as defined in claim 1 wherein:

said enclosing sidewall having a level indicator located thereon, the contents placed within said storage compartment to be at or below said level indicator when said bulbous portion is located within said storage compartment.

3. A storage container comprising:

a base, said base having a bottom wall from which extends an enclosing sidewall defining an interior storage compartment, said bottom wall having a predetermined exterior width, said base having an open top providing access into said storage compartment, said sidewall having a connecting ledge at said open top, said base being transparent permitting observing of the contents contained within said storage compartment;

a solid lid having an attaching flange located at the periphery of said lid, said attaching flange to connect with said connecting ledge closing said storage compartment to the ambient, said solid lid having a bulbous portion, said bulbous portion being locatable exteriorly of said storage compartment enlarging the volume of said storage compartment or optionally said bulbous portion being locatable within said storage compartment decreasing the volume of said storage compartment, said bulbous portion having an interior width which is greater than said exterior width of said bottom wall, whereby said bottom wall of one said storage container is locatable against said interior width of said bulbous portion of another said storage container producing a stacked arrangement; and said attaching flange having reversed identical annular connections, a said annular connection is to connect with said connecting ledge when said bulbous portion is located exteriorly of said storage compartment, said solid lid being physically reversible from said position exteriorly of said storage compartment to said position within said storage compartment with the remaining said annular connection to connect with said connecting ledge when said bulbous portion is located within said storage compartment.

4. The storage container as defined in claim 3 wherein:

said enclosing sidewall having a level indicator thereon, the contents placed within said storage compartment to be at or below said level indicator when said bulbous portion is located within said storage compartment.

* * * * *